US005167173A

United States Patent [19]

Pietras

[11] Patent Number: 5,167,173

[45] Date of Patent: Dec. 1, 1992

[54] TONG

[75] Inventor: Bernd-Georg Pietras, Wedemark, Fed. Rep. of Germany

[73] Assignee: Weatherford/Lamb, Inc., Houston, Tex.

[21] Appl. No.: 805,004

[22] Filed: Dec. 11, 1991

[30] Foreign Application Priority Data

Apr. 12, 1991 [GB] United Kingdom ..... 9107813

[51] Int. Cl.[5] ..... B25B 17/00

[52] U.S. Cl. ..... 81/57.15; 81/57.19

[58] Field of Search ..... 81/57.15, 57.18–57.21

[56] References Cited

U.S. PATENT DOCUMENTS

| | | | |
|---|---|---|---|
| 2,453,369 | 11/1948 | Grable et al. . | |
| 3,021,739 | 2/1962 | Grundman . | |
| 3,059,512 | 10/1962 | Daugherty et al. | 81/57.15 X |
| 3,371,562 | 3/1968 | Kelley . | |
| 3,589,742 | 6/1971 | Flick . | |
| 3,921,473 | 11/1975 | Boyadjieff et al. | 81/57.34 |
| 4,082,017 | 4/1978 | Eckel . | |
| 4,092,881 | 6/1978 | Jurgens et al. . | |
| 4,280,397 | 7/1981 | Peveto . | |
| 4,401,000 | 8/1983 | Kinzbach | 81/57.2 |
| 4,402,052 | 8/1983 | Stone et al. | 364/506 |
| 4,836,064 | 6/1989 | Slator . | |
| 5,081,888 | 1/1992 | Schulze-Beck . | |

FOREIGN PATENT DOCUMENTS 2100639A 6/1982 United Kingdom .

OTHER PUBLICATIONS

1990–91 General Services and Products Catalog Weatherford, 1989.

International Search Report, corresponding PCT application, No. EP9200646.

*Primary Examiner*—James G. Smith

*Attorney, Agent, or Firm*—Guy McClung

[57] ABSTRACT

Methods and apparatuses for imparting rotation to tubular members such as casing, pipe, or tubing; in one aspect such apparatus as a tong having passive jaws mounted on jaw holders which are slidable in recesses in a rotary, the jaw holders having an internally threaded bore which engages a threaded shaft which has a shoulder; in one aspect a power tong with an actuator mounted on a housing of the power tong and which has an advanceable drive shaft movable into a socket in a drive spindle of the threaded shaft so that rotation of the threaded shaft in one sense advances the jaw toward a center of the tong while rotation in the opposite sense withdraws the jaws, the drive shaft withdrawable to enable the rotary to rotate.

11 Claims, 2 Drawing Sheets

TONG

BACKGROUND OF THE INVENTION

1. Field Of The Invention

This invention is directed to apparatuses for imparting rotation to tubular members and in one aspect to power tongs for making and breaking joints between casing, pipe, and tubing.

2. Description Of Related Art

Tongs are used in the drilling industry for gripping and rotating pipes. Generally, the pipes are gripped between one or more passive jaws and one or more active jaws which can be urged against the pipe. Normally, the radial position of the passive jaws or jaws is fixed and consequently these jaws and/or their jaw holders must be changed to accommodate pipes of different diameters. This necessitates the inventory of different parts and requires a certain amount of time for exchanging jaws and related apparatuses to accommodate tubulars of different diameter.

Various prior art tongs have passive jaws that are fixed with respect to the tong. Accommodation of pipe of varying diameter is accomplished with means other than the fixed passive jaw or jaws.

SUMMARY OF THE PRESENT INVENTION

According to the present invention, a tong is provided which in one embodiment has at least one active jaw holder and at least one passive jaw holder, the passive jaw holder movable to different positions to accommodate pipes of differing diameters. Preferably, the passive jaw holder is connected to a drive member so that rotation of the drive member in one direction urges the jaw holder in one direction while rotation of the drive member in the opposite direction urges the jaw holder in the opposite direction. Advantageously, the drive member comprises a threaded shaft, and the passive jaw holder has an internally threaded bore which engages the threaded shaft.

In one embodiment, the tong is a back-up tong, which is simply used for holding a pipe stationary. In another embodiment, the tong is a power tong, which is used for rotating pipe. When the tong is a power tong having a housing and a rotary rotatably mounted therein, the jaw holder is preferably mounted in the rotary and the threaded shaft is arranged to act between the rotary and the jaw holder. In such an embodiment the threaded shaft may be rotated by, for example a screwdriver or a socket driver. In a preferred embodiment an actuator is mounted on the housing which, when actuated, advances a member into engagement with the drive member and rotates it until the jaw holder is in the desired position. The member is subsequently retracted to allow the rotary to rotate with respect to the housing. If desired, a sensor may be provided to inhibit actuation of the actuator when not aligned with said drive member. A sensor may also be provided to inhibit rotation of the drive member until drivingly engaged with said actuator. In one embodiment, two or more passive jaw holders will be present each of which will preferably be adjustable by its own actuator. Preferably, each actuator is computer controlled so that when the diameter of a pipe to be gripped is entered into the computer the passive jaw or jaws are advanced to the desired position. Once the passive jaw or jaws are in position, the pipe is pressed against them by advancing one or more active jaw or jaws against the pipe. In one embodiment this can be achieved mechanically or hydraulically as described and claimed in the co-pending application entitled "Rotary For A Power Tong" filed on even date herewith.

Tongs (e.g. back-up tongs or power tongs) in accordance with the invention may be provided with a jaw holder as described or claimed herein.

It is, therefore, an object of the present invention to provide new, useful, unique, efficient, safe and effective devices and methods for imparting rotation to tubular members.

Another object of the present invention is the provision of such devices and methods including tongs for use with casing, pipe, tubing or other tubular.

Yet another object of the present invention is the provision of such methods and devices which employ a re-positionable passive jaw (or jaws) for accommodating tubulars of different diameter.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

Filed on even date herewith are two applications co-assigned with the present invention, one entitled "Rotary For a Power Tong," and one entitled "Power Tong," copies of which are submitted herewith and which are fully incorporated herein.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

For a better understanding of the invention reference will now be made, by way of example, to the accompanying in which.

DESCRIPTION OF EMBODIMENTS PREFERRED AT THE TIME OF FILING FOR THIS PATENT

Figure 1:
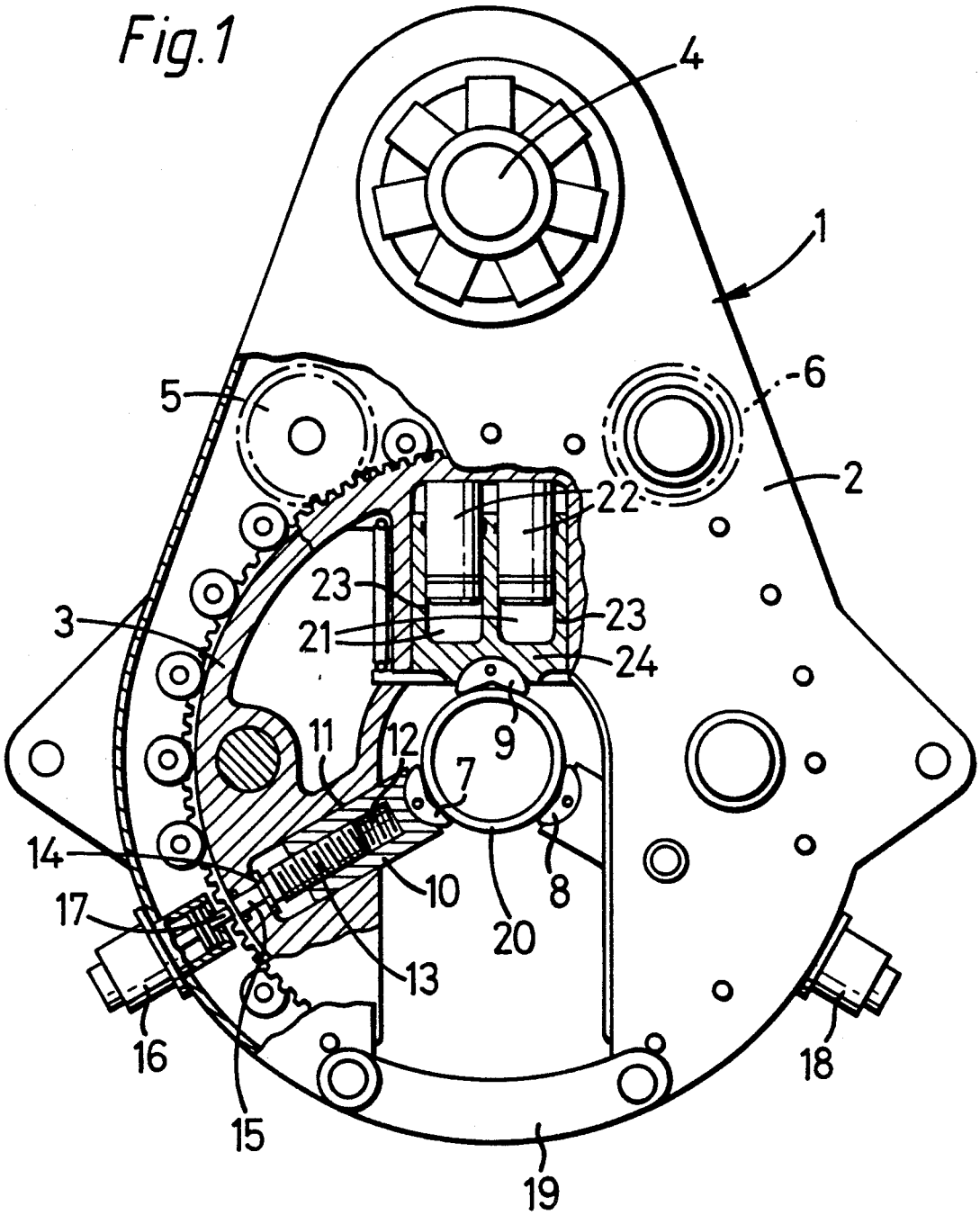
FIG. 1 is a partially cut-away plan view of a power tong in accordance with the present invention.

Referring to FIG. 1, there is shown a power tong which is generally identified by reference numeral 1. The power tong 1 comprises a housing 2 in which is mounted a rotary 3 rotatable by a hydraulic motor 4 acting through a gear train (not shown) including gear wheels 5 and 6. The rotary 3 is provided with two passive jaws 7 and 8 and an active jaw 9.

The passive jaw 7 is held in a jaw holder 10 which is slidably mounted in a recess 11 in the rotary 3. The jaw holder 10 is provided with a threaded bore 12 which engages corresponding threads in a threaded shaft 13. The threaded shaft 13 has a plate 14 which bears against the inner wall of the rotary 3 and a drive spindle 15 which is provided with a socket (not shown).

A hydraulic actuator 16 is mounted on the housing 2 and is provided with a drive shaft 17 which can be advanced radially into engagement with the socket in the drive spindle 15. The hydraulic actuator 16 can also be driven to rotate drive shaft 17 by a required number of turns. When drive shaft 17 is rotated in one sense, jaw holder 10 moves radially inwardly; while when drive shaft 17 is rotated in the opposite sense, jaw holder 10 moves radially outwardly.

The jaw 8 is associated with a similar positioning arrangement which is controlled by the hydraulic actuator 18.

At the commencement of a screwing operation, the jaws 7 and 8 are fully retracted and the gate 19 is opened. The power tong 1 is then advanced until the pipe 20 enters the opening left by the gate 19 and occupies the position shown. The diameter of the pipe 20 has already been supplied to a control computer (not shown) and when the pipe 20 reaches the position shown, the gate 19 is closed and the hydraulic actuators 16 and 18 are then deactivated and their drive shafts retracted under the influence of springs (not shown). The active jaw 9 is then pressed against the pipe 20 with the desired pressure by introducing hydraulic fluid into twin voids 21 between fixed pistons 22 and respective cylinders 23 formed in an active jaw holder 24 carrying jaw 9.

Once the jaws 7, 8 and 9 have fully gripped the pipe 20, the rotary 2 and pipe 20 can be rotated in unison. It will be appreciated that the position of the jaws 7 and 8 can be rapidly adjusted to suit a variety of pipes of different diameters.

Various modifications to the arrangement described are envisaged, for example the diameter of the pipe 20 may automatically be measured as it enters the power tong 1 and the position of the passive jaws 7 and 8 adjusted automatically.

If desired, sensors may be provided to ensure that the drive shaft 17 is not advanced until the socket in the drive spindle 15 is aligned therewith. A sensor may also be provided to inhibit rotation of the drive shaft 17 until it is fully inserted in the socket. A position sensor may also be provided to independently monitor the position of the passive jaws 7 and 8 feeding this information to the computer for making any necessary correction.

While the threaded bore 12 is preferably provided in the jaw holder 10 it will be appreciated that, within the scope of this invention, a threaded shaft is mountable on the jaw holder and that the threaded shaft 13 can be replaced by a rotatable member having a threaded bore to receive the threaded shaft on the jaw holder. If desired, the jaws may be formed as an integral part of their jaw holders.

Figure 2:
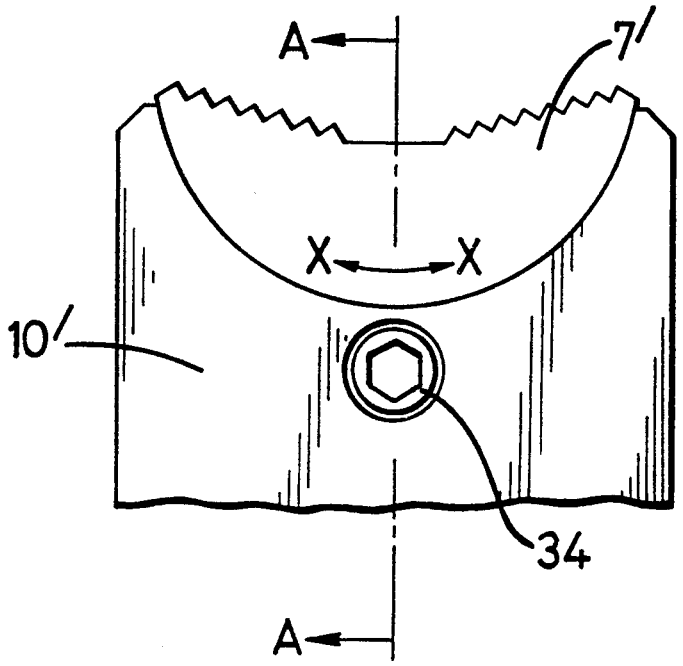
FIG. 2 is a plan view of a jaw mounted on an alternative jaw holder.
Figure 3:
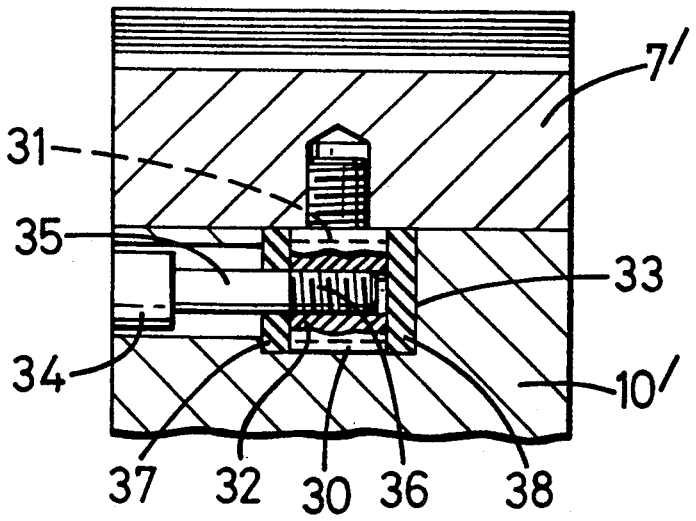
FIG. 3 is a cross-section taken along line A—A of FIG. 2.

FIGS. 2 and 3 show a jaw 7' which is resiliently mounted in jaw holder 10'. A stud 30 having a bore 31 is screwed into the jaw holder 10'. The bore 31 is lined with a sleeve 32 of resilient material. The jaw 7' has a central recess 33 which receives the free end of the stud 30. The jaw 7' is retained by a hex screw 34 which has a shank 35 which threadedly engages the jaw 7' and a tip 36 which extends into the sleeve 32. Resilient material 37, 38 is also placed as shown. The sleeve 32 of resilient material together with the resilient material 37, 38 enables the jaw 7' to make limited movements relative to the jaw holder 10' so that it can become properly aligned with the pipe being gripped.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or strep recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A power tong for rotating tubular members, the tong comprising a housing, a rotary rotatably mounted in the housing for rotating a tubular member, power means for moving the rotary, at least one active jaw holder movably mounted to the rotary, at least two or more passive jaw holders movably mounted to the rotary, and the two or more passive jaw holders movable to different positions to accommodate tubular members of differing diameters, each of the passive jaw holders connected to a respective drive member so that rotation of the drive member in one direction urges the jaw holders in one direction while rotation of the drive member in the opposite direction urges the jaw holders in the opposite direction, the drive member comprising a threaded shaft and the passive jaw holders each having an internally threaded bore which engages the respective threaded shaft, an actuator mounted on the housing and actuable to advance an engaging member into engagement with the drive member and to rotate the rotary until the at least one active jaw holder is in a desired position, a sensor to inhibit actuation of the actuator when not aligned with the drive member, a sensor to inhibit rotation of the drive member until it is drivingly engaged wit the actuator, and the actuator connected to a computer and responsive to signals therefrom.

2. A tong for rotating tubular members, the tong comprising a housing, moving means mounted in the housing for rotating a tubular member, at least one active jaw holder movably mounted to the moving means, at least one passive jaw holder movably mounted to the moving means, the at least one passive jaw holder movable by a rotatable drive member mounted on the housing to different positions to accommodate tubular members of differing diameters, and the at least one passive jaw holder connected to the drive member so that rotation of the drive member in one direction urges the at least one passive jaw holder in one direction while rotation of the drive member in the opposite direction urges the at least one passive jaw holder in the opposite direction.

3. The tong of claim 2, wherein the drive member comprises a threaded shaft and the at least one passive jaw holder has an internally threaded bore which engages the threaded shaft.

4. The tong of claim 2, wherein the tong is a power tong having a power-driven rotary rotatably mounted therein and operatively interconnected with the at least one active jaw holder.

5. The power tong of claim 4, wherein the drive member acts between the rotary and the at least one active jaw holder.

6. The power tong of claim 5, including also an actuator mounted on the housing and actuable to advance an engaging member into engagement with the drive member and to rotate the drive member until the at least one active jaw holder is in a desired position.

7. The power tong of claim 6, including also a sensor to inhibit actuation of the actuator when not aligned with the drive member.

8. The power tong of claim 7, including also a sensor to inhibit rotation of the drive member until it is drivingly engaged with the actuator.

9. The power tong of claim 6, wherein the actuator is connected to a computer and is responsive to signals therefrom.

10. The tong of claim 2 wherein the at least one passive jaw holder is two of more passive jaw holders.

11. A backup tong comprising:

a housing, at least one active jaw holder movably mounted to the housing, at least one passive jaw holder movably mounted to the housing, the at least one passive jaw holder movable by a rotatable drive member in the housing to different positions to accommodate tubular members of differing diameters, and the at least one passive jaw holder connected to the drive member so that rotation of the drive member in one direction urges the at least one passive jaw holder in one direction while rotation of the drive member in the opposite direction urges the at least one passive jaw holder in the opposite direction.

* * * * *